US011744425B2

(12) United States Patent
Zhang

(10) Patent No.: US 11,744,425 B2
(45) Date of Patent: Sep. 5, 2023

(54) VACUUM CLEANER CHARGING DOCK AND VACUUM CLEANER ASSEMBLY

(71) Applicant: Tao Zhang, Jiangsu (CN)

(72) Inventor: Tao Zhang, Jiangsu (CN)

( * ) Notice: Subject to any disclaimer, the term of this patent is extended or adjusted under 35 U.S.C. 154(b) by 6 days.

(21) Appl. No.: 17/560,168

(22) Filed: Dec. 22, 2021

(65) Prior Publication Data

US 2023/0051093 A1 Feb. 16, 2023

(30) Foreign Application Priority Data

Aug. 10, 2021 (CN) ..... 202110911368.3

(51) Int. Cl.
*A47L 9/28* (2006.01)
*A47L 9/04* (2006.01)

(52) U.S. Cl.
CPC ..... *A47L 9/2873* (2013.01); *A47L 9/0477* (2013.01)

(58) Field of Classification Search
CPC .... A47L 9/0009; A47L 9/0063; A47L 9/2873; A47L 9/0477; A47L 2201/02; A47L 2201/028; A47L 2201/022; A47L 2201/024; A47L 11/4091
USPC ..... 15/339, 256.51, 256.62
See application file for complete search history.

(56) References Cited

U.S. PATENT DOCUMENTS 11,013,389 B2 * 5/2021 Resch ..... A47L 7/0004
2012/0013907 A1 * 1/2012 Jung ..... A47L 9/28 356/438
2018/0296051 A1 * 10/2018 Jung ..... A47L 9/2805
2018/0344112 A1 * 12/2018 Krebs ..... A47L 9/0063
2019/0314863 A1 * 10/2019 VandenBergh ..... B08B 1/007
2021/0093143 A1 * 4/2021 Nguyen ..... A47L 11/4016
2021/0369072 A1 * 12/2021 Gao ..... A47L 9/2873
2022/0211241 A1 * 7/2022 Zheng ..... A47L 11/4036
2022/0248920 A1 * 8/2022 Brugora ..... A47L 9/0477

FOREIGN PATENT DOCUMENTS

CN 112617684 A * 4/2021 ..... A47L 11/282
EP 4094659 A1 * 11/2022

OTHER PUBLICATIONS

EP-4094659-A1 description translation Espacenet (Year: 2023).*
CN-112617684-A description translation Espacenet (Year: 2023).*

* cited by examiner

*Primary Examiner* — Brian D Keller
*Assistant Examiner* — Tim Brady
(74) *Attorney, Agent, or Firm* — Kunzler Bean & Adamson; Michael Bartholomew

(57) ABSTRACT

A vacuum cleaner charging dock comprising a base and a bracket is provided. The bracket is arranged on one side of the base and is provided with a charging socket for charging a vacuum cleaner, while a positioning slot is arranged on another side of the base, the positioning slot is used for containing a floor brush of the vacuum cleaner, the positioning slot is provided with a plurality of convex teeth, which are used for rubbing with a rolling brush on the floor brush. The vacuum cleaner charging dock is provided with convex teeth, and the rolling brush of floor brush has deformation contact with the convex teeth. When the rolling brush starts to rotate, the convex teeth are easy to perform frictional rotation. Then dust and sewage on the rolling brush are shaken off into a positioning slot to complete the cleaning to the rolling brush, which is convenient and efficient.

16 Claims, 4 Drawing Sheets

VACUUM CLEANER CHARGING DOCK AND VACUUM CLEANER ASSEMBLY

CROSS-REFERENCES TO RELATED APPLICATIONS

This application is a Paris Convention application, which claims priority to Chinese Patent Application No. 202110911368.3, filed on Aug. 10, 2021, the content of all of which is incorporated herein by reference.

FIELD OF THE INVENTION

The present disclosure relates to a vacuum cleaner device, and, more particularly, to a vacuum cleaner charging dock and vacuum cleaner assembly.

BACKGROUND

A rolling brush of a vacuum cleaner is an important part of the vacuum cleaner. During the cleaning work, the rolling brush is driven by a motor to quickly rotate to clean the floor. When the vacuum cleaner rolling brush performs multiple cleaning actions, dust and debris will accumulate in it. If it is not cleaned up, the subsequent cleaning effect will be affected.

When cleaning the rolling brush, it can be removed from a floor brush of the vacuum cleaner and cleaned separately. However, disassembly and installation in this manner will lead to trivial steps, affect cleaning efficiency, and affect the normal use of the vacuum cleaner.

SUMMARY OF THE DISCLOSURE

The purpose of the present disclosure is to provide a vacuum cleaner charging dock and vacuum cleaner assembly. The vacuum cleaner charging dock is provided with convex teeth, and the rolling brush of floor brush has deformation contact with the convex teeth. When the rolling brush starts to rotate, the convex teeth are easy to perform frictional rotation. Then dust and sewage on the rolling brush are shaken off into a positioning slot, and finally sucked into a dust collection box of the vacuum cleaner through the suction inlet of the floor brush to complete the cleaning to the rolling brush, which is convenient and efficient.

In order to achieve the above objective, the present disclosure provide a technical solution as: A vacuum cleaner charging dock, wherein comprises a base and a bracket, the bracket is arranged on one side of the base and is provided with a charging socket for charging a vacuum cleaner, while a positioning slot is arranged on another side of the base, which is used for containing a floor brush of the vacuum cleaner, the positioning slot is provided with a plurality of convex teeth inside, which are used for rubbing with a rolling brush on the floor brush.

As a further optimization, the convex teeth comprise a base block, a side of the base block away from the bracket has a gentle slope, and a side of the base block close to the bracket has a steep slope, the gentle slope and the steep slope are connected by a top arc surface.

As a further optimization, a depositing pit is arranged inside the positioning slot, and the convex teeth are formed in the depositing pit.

As a further optimization, a vertical section of the depositing pit is an arc matching with a vertical section of the rolling brush.

As a further optimization, the plurality of the convex teeth are arranged in a straight line.

As a further optimization, the plurality of the convex teeth are arranged in a matrix to form at least two linear convex tooth bands, and a gap exists between a pair of adjacent convex teeth on the same convex tooth band.

As a further optimization, there are two convex tooth bands, and on the two convex tooth bands the convex teeth are arranged in a staggered manner.

As a further optimization, the two convex tooth bands are respectively located in two sides of bottom of the depositing pit.

As a further optimization, the positioning seat is provided within the positioning slot; a positioning cavity is provided within the positioning slot; the upper end of the bracket is provided with a battery positioning cavity, the charging socket is arranged in the battery positioning cavity.

The present disclosure also provide a vacuum cleaner assembly, wherein comprises a vacuum cleaner and the vacuum cleaner charging dock, the floor brush and battery of the vacuum cleaner are respectively positioned on the base and the bracket of the vacuum cleaner charging dock, the floor brush is embedded in the positioning slot, the rolling brush of floor brush has deformation contact with the convex teeth, and the battery is electrically connected with the charging socket.

Compared with the prior art, the present disclosure has the following benefits:

1. When charging the vacuum cleaner, the floor brush of the vacuum cleaner can be placed in the positioning slot, the rolling brush of the floor brush facilitates deformation contact with the convex teeth. When the rolling brush starts to rotate, the convex teeth are easy to perform frictional rotation, then dust and sewage on the rolling brush are shaken off into a positioning slot, and finally sucked into a dust collection box of the vacuum cleaner through the suction inlet of the floor brush to complete the cleaning to the rolling brush, which is convenient and efficient.

2. By setting the depositing slot, which is equivalent to the receiving slot, the lower part of the rolling brush can be embedded in the depositing slot, and at the same time two convex tooth bands are arranged on two sides of the depositing slot, and the rolling brush is cleaned by the bottom, which prevent dust and sewage from dispersing everywhere, and the depositing slot can also better collect the dust and sewage shaken off by the rolling brush.

DETAILED DESCRIPTION

In order to further describe the technical solutions of the present disclosure, specific embodiments of the present disclosure combined with the accompanying drawings are stand here. It should be understood that the detailed embodiments of the disclosure described here are used to explain the present disclosure only, instead of limiting the present disclosure.

Figure 1:
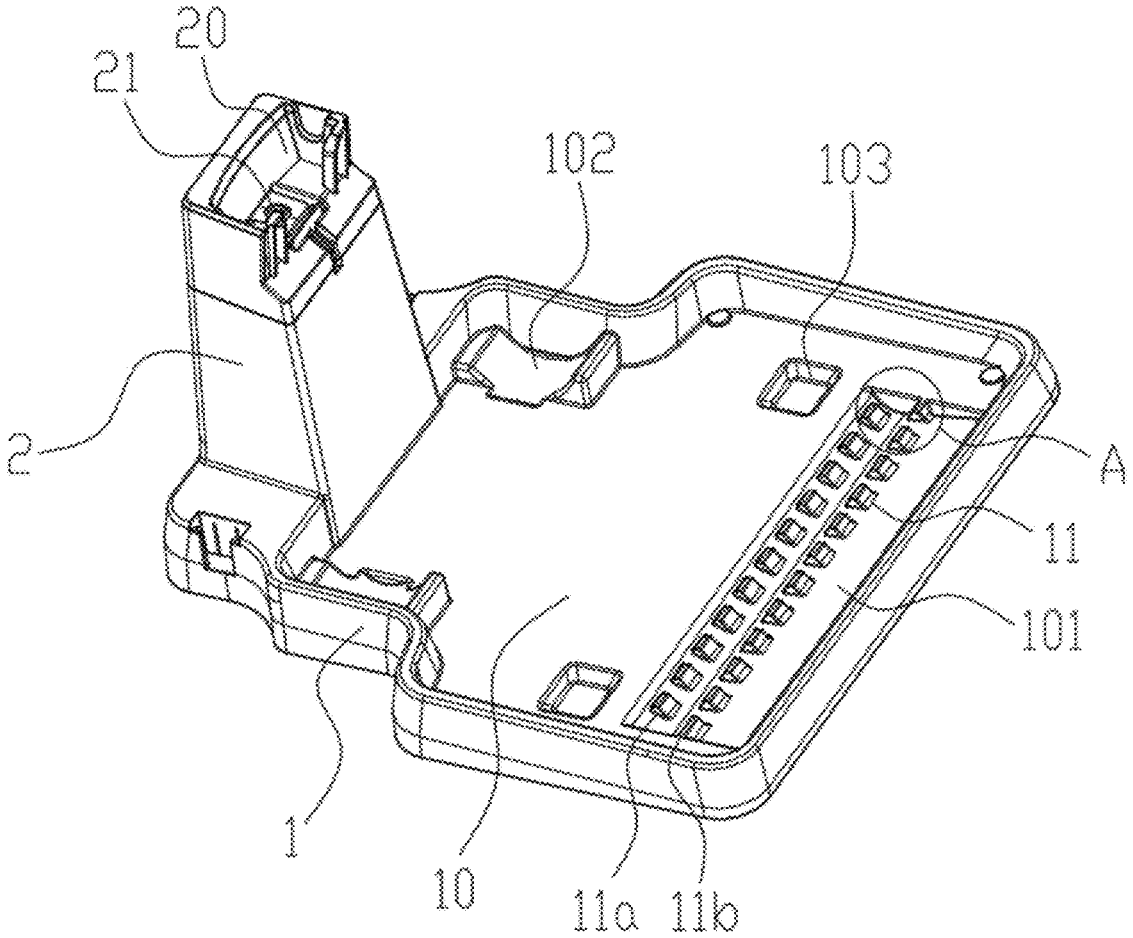
FIG. 1 illustrates a structural diagram of the vacuum cleaner charging dock according to the present disclosure.
Figure 2:
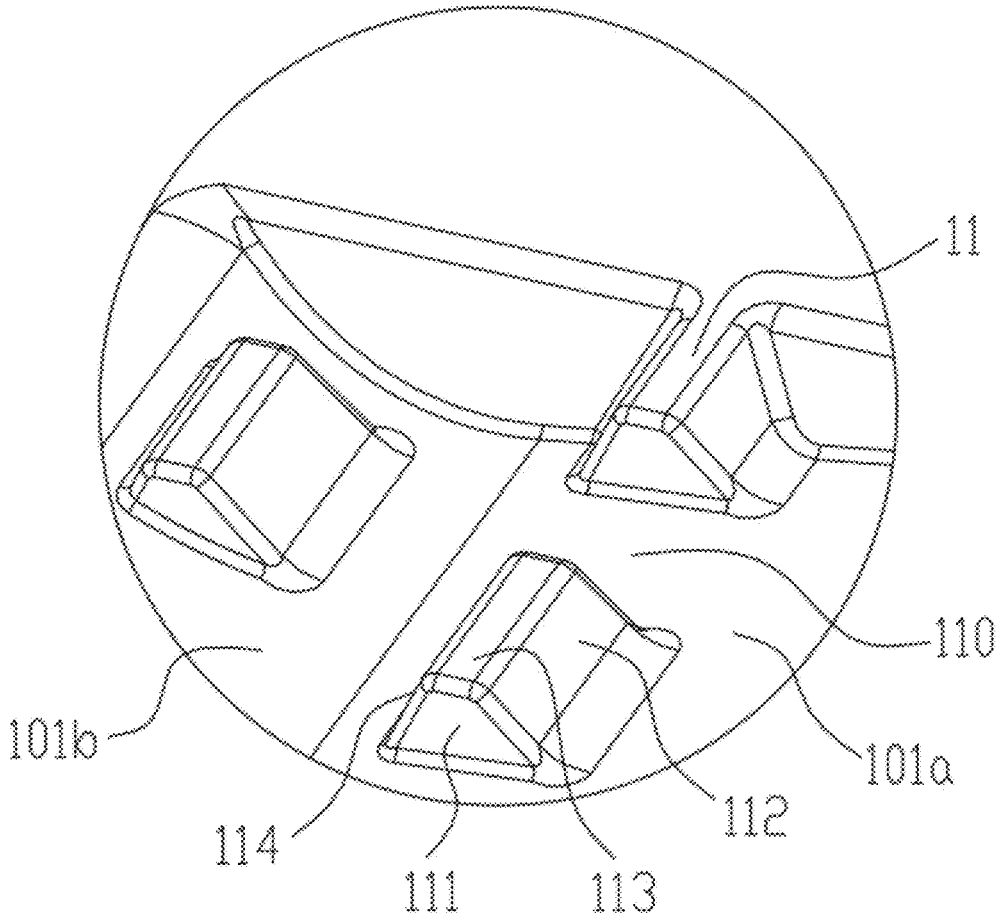
FIG. 2 is a partial enlarged view of an area labeled A in FIG. 1.

As shown in FIGS. 1-2, a vacuum cleaner charging dock includes base 1 and bracket 2, the bracket 2 is arranged on one side of the base 1 and is provided with a charging socket 21 for charging a vacuum cleaner, while a positioning slot 10 is arranged on another side of the base 1, the positioning slot 10 is used for containing a floor brush of the vacuum cleaner, the positioning slot 10 is provided with a plurality of convex teeth 11, which are used for rubbing with a rolling brush on the floor brush.

When charging the vacuum cleaner, the floor brush of the vacuum cleaner can be placed in the positioning slot 10, the rolling brush of the floor brush facilitates deformation contact with the convex teeth 11. When the rolling brush starts to rotate, the convex teeth 11 are easy to perform frictional rotation, then dust and sewage on the rolling brush are shaken off into the positioning slot 10, and finally sucked into a dust collection box of the vacuum cleaner through the suction inlet of the floor brush to complete the cleaning to the rolling brush, which is convenient and efficient.

The convex teeth 11 comprise a base block 111, a side of the base block 111 away from the bracket 2 has a gentle slope 112, and a side of the base block 111 close to the bracket 2 has a steep slope 114, the gentle slope 112 and the steep slope 114 are connected by a top arc surface 113.

The gentle slope 112 locates along a tangent direction of the rolling brush movement. The gentle slope 112 squeezes and deforms the rolling brush to squeeze out the sewage, and then the rolling brush passes through the top arc surface 113. Therefore, the deformation of the rolling brush is restored, which results in jitter and can shake off the dust.

A depositing pit 101 is arranged inside the positioning slot 10, and the convex teeth 11 is formed in the depositing pit 101.

By setting the depositing slot 10, the lower part of the rolling brush can be embedded in the depositing slot, and at the same time the convex teeth 11 are arranged inside the depositing slot. The rolling brush is cleaned by the bottom, which prevent dust and sewage from dispersing everywhere, and the depositing slot can also better collect the dust and sewage shaken off by the rolling brush.

In this embodiment, the convex teeth 11 are arranged in two lines to form two convex tooth bands. The two convex tooth bands includes a rear convex tooth band 11*a* and a front convex tooth band 11*b*. The convex teeth 11 on the two convex tooth bands 11*a* and 11*b* are arranged in a staggered manner, which can cover the length of the rolling brush in the axial direction and can be completely cleaned.

In one embodiment, the plurality of the convex teeth 11 are arranged in a straight line.

In another embodiment, the plurality of the convex teeth 11 are arranged in a matrix to form at least two linear convex tooth bands, and a gap 110 exists between a pair of adjacent convex teeth 11 on the same convex tooth band. The gap 110 can reduce the resistance when the rolling brush crosses the convex tooth band, and the rolling brush can be cleaned many times and at multiple locations through a plurality of convex tooth bands.

The rear convex tooth band 11*a* and the front convex tooth band 11*b* are respectively settled at two sides of a bottom of the depositing pit 101, i.e., respectively settled inside a rear depositing pit 101*b* and a front depositing pit 101*a*, which locates at the same axial position on the rolling brush. Firstly, the rolling brush 321 passes through the front depositing pit 101*a*, after interval (due to the gap) jitter caused by the front convex tooth band 11*b*, portions of which not contact with the convex teeth 11 accommodating part of the deformation, making it easier to pass through the front convex tooth band 11*b*. When the rolling brush 321 moving to the rear depositing pit 101*b*, the convex teeth 11 of the rear convex tooth band 11*a* misaligned with the convex teeth 11 of the front convex tooth band 11*b*, rubbing the unshaking part of the front convex tooth band 11*b* to clean up the dust and sewage of this part. Portions of the front convex tooth band 11*b* not contacting with the convex teeth 11 can also accommodate part of the deformation, making it easier to pass through the front convex tooth band 11*b*. Therefore, the front and rear convex tooth bands cooperate to complete the jitter cleaning of the same position in an axial direction of the rolling brush, and the gap reduces resistance and prevents excessive resistance from making it difficult for the rolling brush to cross the convex tooth band or offset the top of the floor brush; a low-lying place is formed at the junction of the front and rear depositing pit 101*b*, where dust and sewage can be collected to facilitate subsequent cleaning and collection.

A floor brush roller positioning seat 102 is provided within the positioning slot 10 to place the rolling brush of the floor brush; a positioning cavity 103 is provided within the positioning slot 10; the upper end of the bracket 2 is provided with a battery positioning cavity 20, and the charging socket 21 is arranged in the battery positioning cavity 20.

Figure 3:
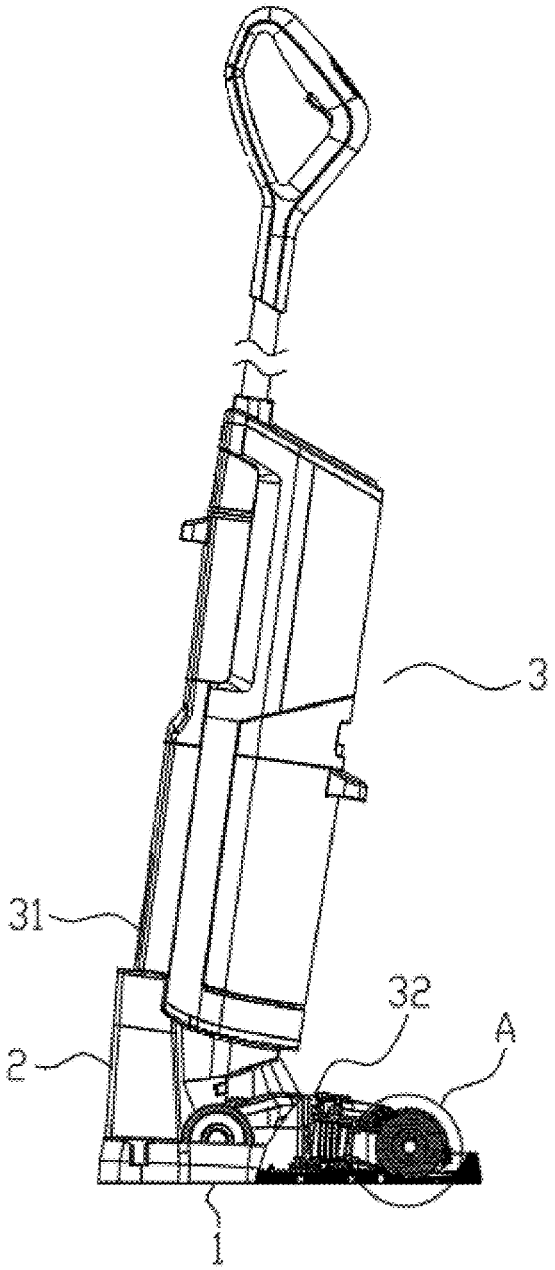
FIG. 3 illustrates a structural diagram of the vacuum cleaner assembly according to the present disclosure.
Figure 4:
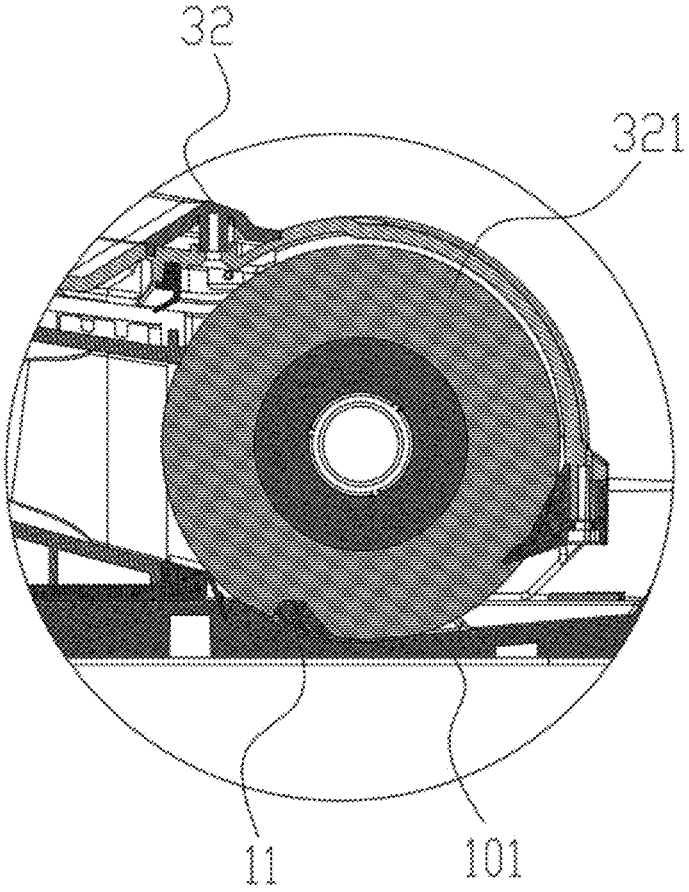
FIG. 4 is a partial enlarged view of an area labeled A in FIG. 3.

As shown in FIGS. 3 and 4, a vacuum cleaner assembly is shown. The vacuum cleaner assembly comprises a vacuum cleaner 3 and a vacuum cleaner charging dock as described above. The floor brush 32 and battery 31 of the vacuum cleaner are respectively positioned on the base 1 and the bracket 2 of the vacuum cleaner charging dock, the floor brush 32 is embedded in the positioning slot 10, the rolling brush 321 of floor brush 32 has deformation contact with the convex teeth 11. When the rolling brush 321 rotates, the convex teeth 11 squeeze and rub the rolling brush 321 to realize the function of the rolling brush 321 shaking off dust and sewage. The battery 31 is electrically connected with the charging socket 21.

The specific embodiments described herein are examples to illustrate the spirit of the present disclosure only and not limiting the scope of this disclosure. Those skilled in the art to which the present disclosure belongs can make various modifications or additions to the specific embodiments described or use similar alternatives, but they will not deviate from the spirit or exceed the scope of the present disclosure.

What is claimed is:

1. A vacuum cleaner charging dock, comprising a base including two sides;

a bracket arranged on one side of the base and coupled to a charging socket for charging a vacuum cleaner; and a positioning slot arranged on another side of the base and configured for containing a floor brush of the vacuum cleaner, wherein the positioning slot is provided with a plurality of convex teeth configured for rubbing with a rolling brush on the floor brush, wherein the convex teeth are not in contact with each other and each of the convex teeth comprises a base block, a side of the base block away from the bracket has a gentle slope, a side of the base block close to the bracket has a steep slope, and the gentle slope and the steep slope are connected by a top arc surface.

2. The vacuum cleaner charging dock according to claim 1, wherein the convex teeth are arranged in a straight line.

3. The vacuum cleaner charging dock according to claim 1, wherein a floor brush roller positioning seat is provided within the positioning slot; a positioning cavity is provided within the positioning slot; an upper end of the bracket is provided with a battery positioning cavity, and the charging socket is arranged in the battery positioning cavity.

4. The vacuum cleaner charging dock according to claim 1, wherein a depositing pit is arranged inside the positioning slot, and the convex teeth are formed in the depositing pit.

5. The vacuum cleaner charging dock according to claim 4, wherein a vertical section of the depositing pit is an arc matching with a vertical section of the rolling brush.

6. The vacuum cleaner charging dock according to claim 4, wherein the convex teeth are arranged in a matrix to form at least two linear convex tooth bands, and a gap is defined between two adjacent convex teeth on a same convex tooth band.

7. The vacuum cleaner charging dock according to claim 4, wherein the convex teeth comprises two convex tooth bands, and the convex teeth of the two convex tooth bands are arranged in a staggered manner.

8. The vacuum cleaner charging dock according to claim 7, wherein the two convex tooth bands are respectively located on two sides of a bottom of the depositing pit.

9. A vacuum cleaner assembly, comprising a vacuum cleaner and the vacuum cleaner charging dock according to claim 1, wherein the floor brush and a battery of the vacuum cleaner are respectively positioned on the base and the bracket of the vacuum cleaner charging dock, the floor brush is embedded in the positioning slot, the rolling brush of the floor brush has deformation contact with the plurality of convex teeth, and the battery is electrically connected with the charging socket, wherein the convex teeth are not in contact with each other and each of the convex teeth comprises a base block, a side of the base block away from the bracket has a gentle slope, a side of the base block close to the bracket has a steep slope, and the gentle slope and the steep slope are connected by a top arc surface.

10. The vacuum cleaner assembly according to claim 9, wherein a depositing pit is arranged inside the positioning slot, and the convex teeth are formed in the depositing pit.

11. The vacuum cleaner assembly according to claim 9, wherein a depositing pit is arranged inside the positioning slot, and the convex teeth are formed in the depositing pit.

12. The vacuum cleaner assembly according to claim 9, wherein the convex teeth are arranged in a straight line.

13. The vacuum cleaner assembly according to claim 9, wherein the convex teeth are arranged in a matrix to form at least two linear convex tooth bands, and a gap is defined between two adjacent convex teeth on a same convex tooth band.

14. The vacuum cleaner assembly according to claim 9, wherein the convex teeth comprises two convex tooth bands, and the convex teeth of the two convex tooth bands are arranged in a staggered manner.

15. The vacuum cleaner assembly according to claim 9, wherein the two convex tooth bands are respectively located in two sides of a bottom of the depositing pit.

16. The vacuum cleaner assembly according to claim 9, wherein a floor brush roller positioning seat is provided within the positioning slot; a positioning cavity is provided within the positioning slot; an upper end of the bracket is provided with a battery positioning cavity, and the charging socket is arranged in the battery positioning cavity.

* * * * *